US005522252A

United States Patent [19]

Tsai et al.

[11] Patent Number: 5,522,252

[45] Date of Patent: Jun. 4, 1996

[54] DEVICE DETECTING EXCESSIVE WEAR OF A CARBON WIPER OF AN AUTOTRANSFORMER

[76] Inventors: Jinn-huei Tsai, No. 59, Sec. 1, Yi-an Rd., Tainan; Yueh-chuan Wu, No. 149, Sinyi Rd., Kueijen Hsiang, Tainan Hsien, both of Taiwan

[21] Appl. No.: 506,102

[22] Filed: Jul. 24, 1995

[51] Int. Cl.[6] ..... G08B 21/00

[52] U.S. Cl. ..... 73/7; 340/646

[58] Field of Search ..... 73/7; 324/537, 324/756, 761, 763, 772, 538, 546, 547; 340/645, 648, 652, 653, 644

[56] References Cited

U.S. PATENT DOCUMENTS 532,782 1/1895 Henry ..... 310/242

4,024,525 5/1977 Baumgartner et al. ..... 340/648

4,831,302 5/1989 Dietrich et al. .

FOREIGN PATENT DOCUMENTS 755007 8/1956 United Kingdom ..... 340/648

*Primary Examiner*—Robert Raevis

*Attorney, Agent, or Firm*—Testa, Hurwitz & Thibeault

[57] ABSTRACT

A detection device for detecting excessive wear of a carbon brush of an autotransformer includes a winding wound on a toroidal iron core, a shaft secured by the iron core, a rotary arm extending from the shaft with a hole facing the iron core, a copper block slidably received within the hole of the rotary arm with a flange for preventing the block from passing through the hole of the rotary arm, a carbon brush mounted under the copper block in contact with the winding, a wire connected to the copper block, and a detection means secured on the rotary arm and under the flange for contacting the flange when the carbon brush is excessively worn.

3 Claims, 3 Drawing Sheets

DEVICE DETECTING EXCESSIVE WEAR OF A CARBON WIPER OF AN AUTOTRANSFORMER

BACKGROUND OF THE INVENTION

The present invention relates to a detection device, and particularly to a detection device for detecting excessive wear of a carbon brush of an autotransformer.

Conventional autotransformers consist of a single winding wound on a toroidal iron core and a shaft extends from a rotary arm with a carbon brush under the rotary arm for contacting with exposed turns of the transformer winding. However, as the rotary arm is frequently rotated by a hand of a user or a coaxial-coupled motor of a control system, the carbon brush will be worn out after a long-term utilization. Thus, an interconnection between the carbon brush and the winding is poor so that a sparking occurs at the autotransformer and a phase of a three-phase transformer may be disconnected. This results in fluctuation in an output voltage of the autotransformer and increases the possibility of burning down the apparatus connected to the autotransformer.

SUMMARY OF THE INVENTION

An object of the present invention is to provide a detection device for detecting excessive wear of an autotransformer carbon brush.

According to the present invention, a detection device for detecting excessive wear of a carbon brush of an autotransformer includes a winding wound on a toroidal iron core, a shaft secured by the iron core, a rotary arm extending from the shaft with a hole facing the iron core, a copper block slidably received within the hole of the rotary arm with a flange for preventing the block from passing through the hole of the rotary arm, a carbon brush mounted under the copper block in contact with the winding, a wire connected to the copper block, and a detection means secured on the rotary arm and under the flange for contacting the flange when the carbon brush is worn out.

Other objects, advantages, and novel features of the invention will become more apparent from the following detailed description when taken in conjunction with the accompanying drawings.

DETAILED DESCRIPTION OF THE PREFERRED EMBODIMENTS

Figure 3:
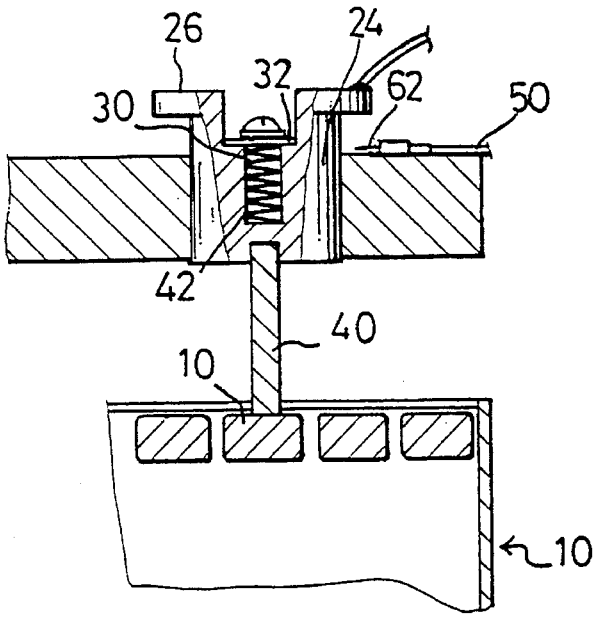
FIG. 3 is a partially cross-sectional view of the autotransformer of FIG. 1.

Referring now to drawings wherein like reference characters designate identical or corresponding parts through the several views.

Figure 1:
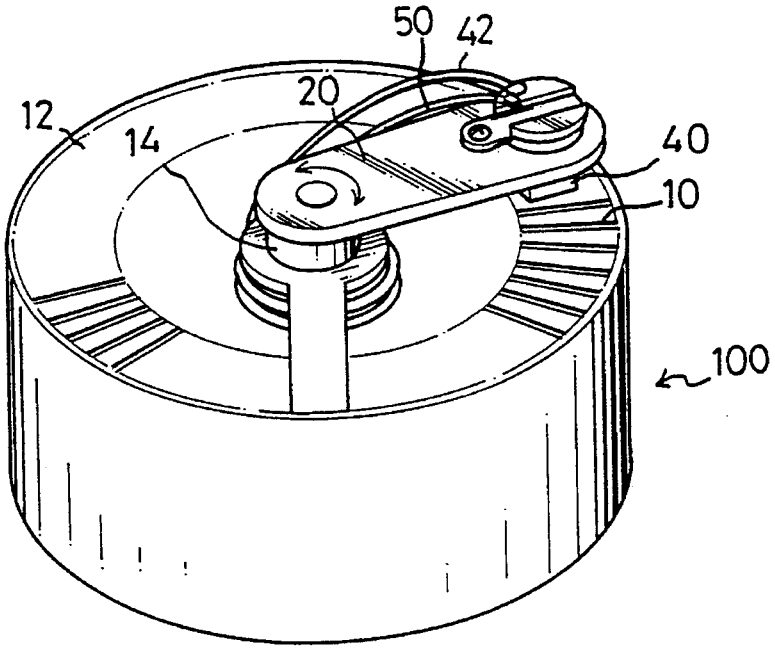
FIG. 1 is a perspective view of an autotransformer in combination with a detection device according to the present invention.

Referring to FIG. 1, an autotransformer 100 includes a single winding 10 wound on a toroidal iron core 12, a shaft 14 secured by the iron core 12, a rotary arm 20 extending from the shaft 14 onto the iron core 12, a carbon brush 40 mounted under the rotary arm 20 in contact with the winding 10, a wire 42 electrically connected to the carbon brush 40 for outputting an output voltage, and a wire 50 connected to a detection means (not shown) for providing a warning signal when the carbon brush 40 is worn out.

Figure 2:
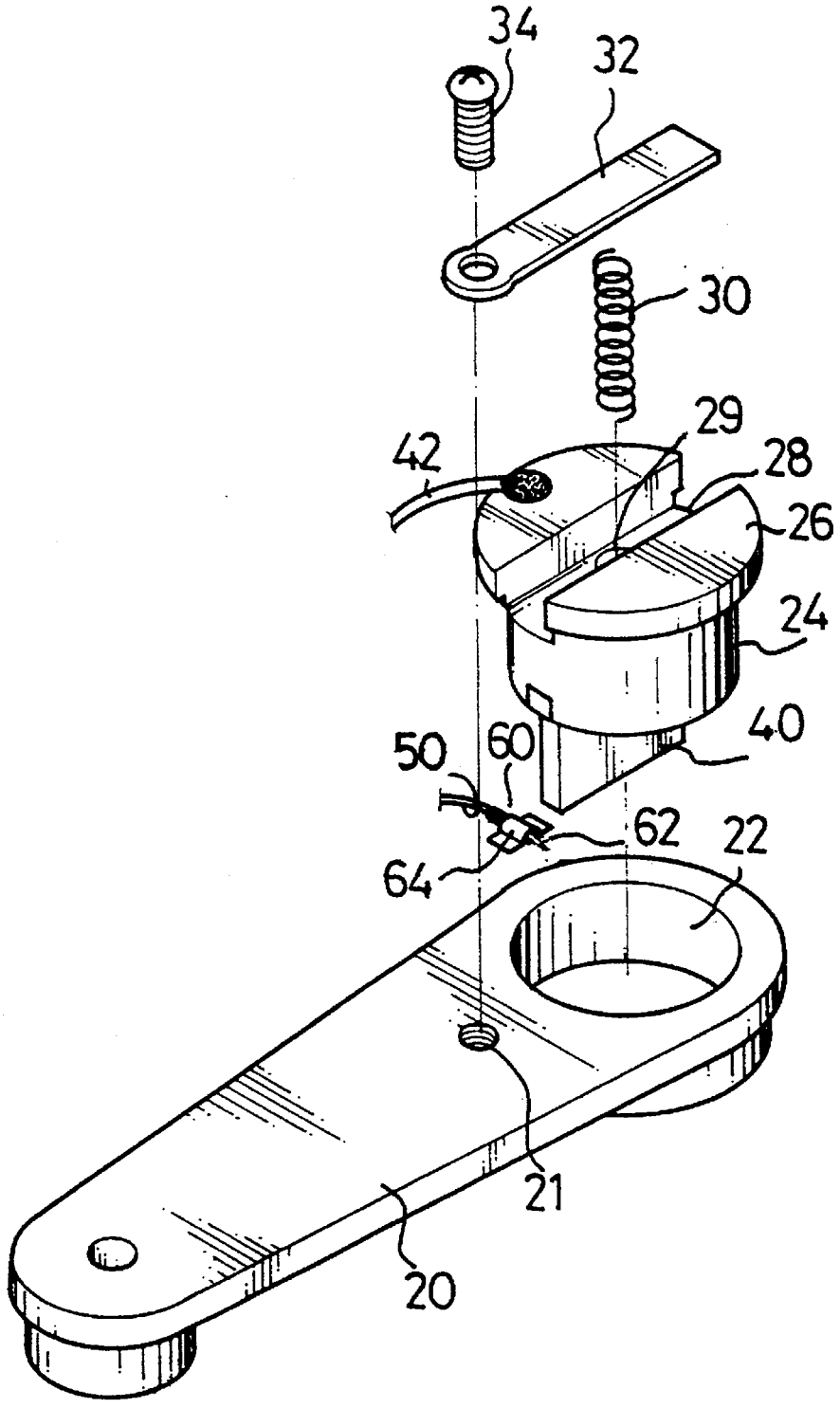
FIG. 2 is an exploded view of a rotary arm of the autotransformer of FIG. 1.

As shown in FIG. 2, the rotary arm 20 includes a threaded aperture 21, a hole 22 defined on a distal end, a copper block 24 slidably received within the hole 22 with the carbon brush 40 connected thereunder and the wire 42 connected thereon. The copper block 24 has a flange 26 defined on a periphery of the block for preventing the block 24 from passing through the hole 22, a slot 28 defined on the block 24, a bore 29 defined in a base defining the slot 28 for receiving a spring 30, a plate 32 received within the slot 28 for pressing the spring 30 into the bore 29 with an end mounted onto the rotary arm 20 by having a screw 34 engage with the aperture 21. A detection means 60 includes a pin 62 secured under the flanges 26 of the block 24 and connected with the wire 50, the pin 62 will contact the flange 26 when the carbon brush 40 wears out and a clip 64 for securing the pin 62 on an edge of the hole 22.

Referring to FIG. 3, the carbon brush 40 contacts with the winding 10 for outputting a desired voltage. When the carbon brush 40 is worn out after long-term utilization, the spring 30 secured by the plate 32 will force the block 24 downward and make the pin 62 contact the flange 26 of the block 24 so that the wire 50 will have a voltage signal which can be used to indicate that the carbon brush 40 is worn out.

Figure 4:
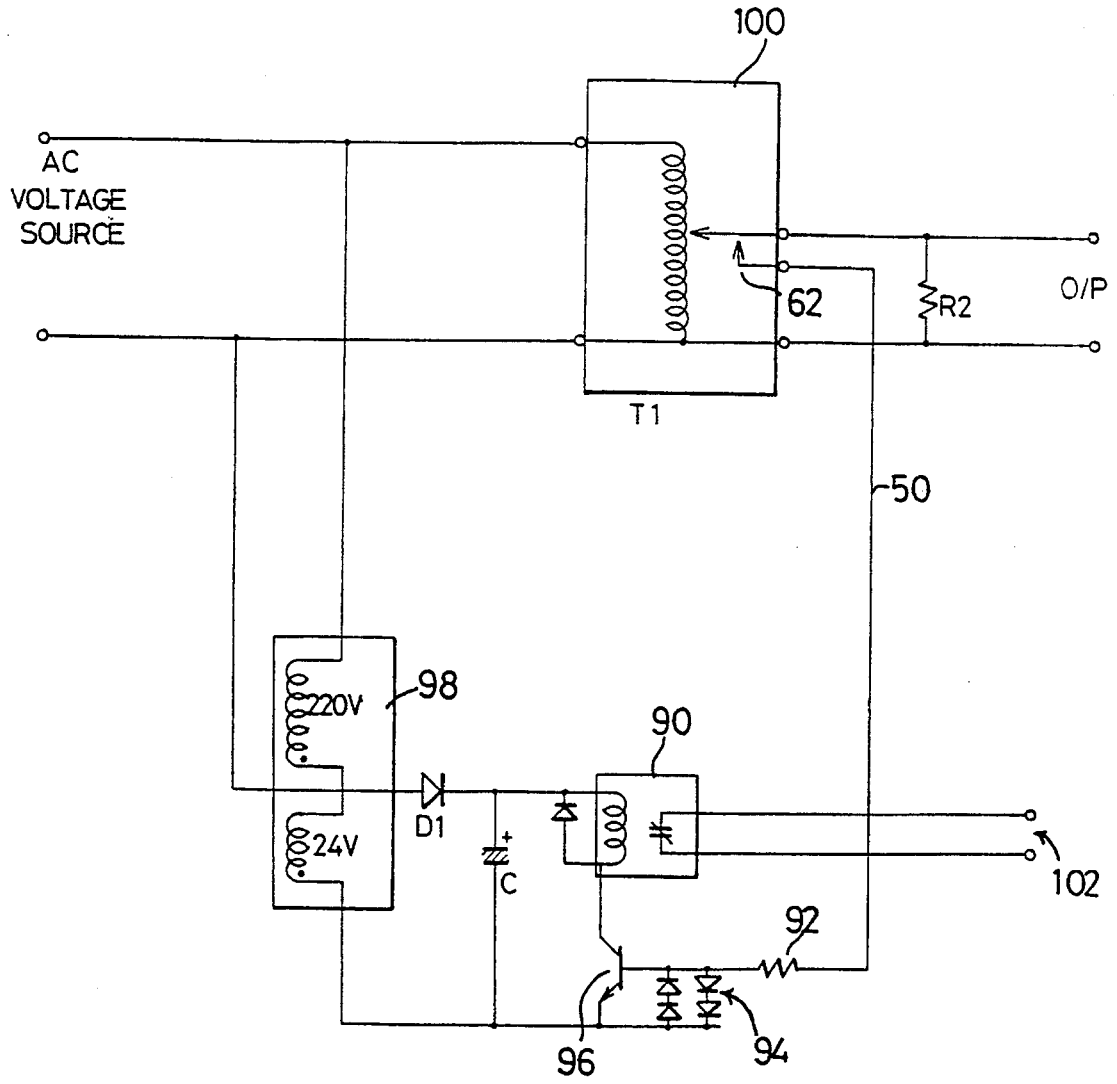
FIG. 4 is a circuit diagram of a power circuit incorporated the detection device of the present invention.

A circuit diagram incorporated with the autotransformer 100 of the present invention is shown in FIG. 4. The autotransformer 100 receives a signal from an AC voltage source and outputs a desired voltage via a resistor R2. When the carbon brush 40 in FIG. 3 is worn out, the pin 62 will sense a voltage signal. The voltage signal is then sent onto a relay 90 via the wire 50, a resistor 92, a diode array 94, and a transistor 96. Thus, the relay 90 is energized, an associated contact thereof will change state and a corresponding signal will generate at a terminal 102 for further processing, such as braking down the voltage source and activating an alarm. A transformer 98 receives a voltage from the AC voltage source for providing a DC voltage to the relay 90 via a diode D1 and a capacitor C. Therefore, the possible damage caused by the fluctuation of the output voltage is thus prevented.

Although the invention has been explained in relation to its preferred embodiment, it is to be understood that many other possible modifications and variations can be made without departing from the spirit and scope of the invention as hereinafter claimed.

What is claimed is:

1. A detection device for detecting excessive wear of a carbon brush of an autotransformer, comprising:

a winding wound on a toroidal iron core;

a shaft secured by the iron core;

a rotary arm extending from the shaft with a hole facing the iron core;

a copper block slidably received within the hole of the rotary arm with a flange for protecting the block from passing through the hole of the rotary arm;

a carbon brush mounted under the copper block in contact with the winding;

a wire connected to the copper block; and a detection means secured on the rotary arm and under the flange for contacting the flange when the carbon brush is worn out.

2. A detection device according to claim 1, wherein said detection means is a micro switch.

3. A detection device according to claim 1, wherein said detection means is a pin.

* * * * *